US006640935B1

(12) United States Patent
Murakami et al.

(10) Patent No.: US 6,640,935 B1
(45) **Date of Patent: *Nov. 4, 2003**

(54) ELEVATOR HAVING VIBRATION DAMPING TO ATTENUATE VIBRATION TRANSFER TO AN ELEVATOR CAGE

(75) Inventors: Shin Murakami, Tokyo (JP); Shigeo Nakagaki, Saitama-ken (JP); Yoshiaki Fujita, Tokyo (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/392,258

(22) Filed: Sep. 9, 1999

(30) Foreign Application Priority Data

Sep. 9, 1998 (JP) ..... H10-255516

(51) Int. Cl.[7] ..... B66B 7/08

(52) U.S. Cl. ..... 187/401; 187/264; 187/292; 187/345

(58) Field of Search ..... 187/264, 266, 187/292, 401, 345

(56) References Cited

U.S. PATENT DOCUMENTS 4,113,064 A 9/1978 Shigeta et al.
4,977,980 A * 12/1990 Hifumi ..... 187/401 X
5,027,925 A * 7/1991 Kahkipuro ..... 187/292
5,613,667 A 3/1997 Ho

FOREIGN PATENT DOCUMENTS

| | | | |
|---|---|---|---|
| FR | 2 647 097 | 11/1990 | |
| JP | 47-51625 | 12/1972 | |
| JP | 4-144891 A * | 5/1992 | ..... 187/401 |
| JP | 7-10421 A * | 1/1995 | |
| JP | 2593288 | 12/1996 | |
| JP | 9-208154 A * | 8/1997 | |
| JP | 10-182035 A * | 7/1998 | |

OTHER PUBLICATIONS

European Search Report.

* cited by examiner

*Primary Examiner*—Eileen D. Lillis
*Assistant Examiner*—Thuy V. Tran
(74) *Attorney, Agent, or Firm*—Oblon, Spivak, McClelland, Maier & Neustadt, P.C.

(57) ABSTRACT

An elevator including a cage for accommodating passengers configured to move up and down in a shaft along a guide rail, a support base attached to a lower portion of the cage, a plurality of car sheaves rotatably secured to the support base through respective axles, a cable placed around the car sheaves and configured to suspend the cage, and at least one damper coupled to the cage and configured to attenuate vibration transferred from the cable to the cage.

16 Claims, 10 Drawing Sheets

ELEVATOR HAVING VIBRATION DAMPING TO ATTENUATE VIBRATION TRANSFER TO AN ELEVATOR CAGE

CROSS REFERENCE TO RELATED APPLICATION

This application claims benefit of priority to Japanese Patent Application No. JP10-255516 filed Sep. 9, 1998, the entire disclosure of which is incorporated by reference herein.

BACKGROUND OF THE INVENTION

1. Field of the Invention

The present invention relates to an elevator having a cage suspended by cables putting around car sheaves.

2. Description of the Background

FIG. 1 is a front view of one example of a traction type elevator and FIG. 2 is a perspective view of an elevator cage shown in FIG. 1.

In FIG. 1 and FIG. 2, opposite ends of a cable 82 are secured to the upper part of a shaft 83. The cable 82 is placed around a traction sheave 85 driven by a hoisting machine 84 having a motor (not shown). A cage 80 for accommodating passengers and a counterweight 86 for balancing the cage 80 are suspended by the cable 82 through a weight sheave 87 of the counterweight 86 and car sheaves 81 of the cage 80.

In this type of elevator, the cable 82 and the traction sheave 85 are located within the space between the cage 80 and a shaft wall 88. Therefore, if the hoisting machine 84 driving the traction sheave 85 is located within the space between the cage 80 and the shaft wall 88, the cage 80 can move up and down without expanding the size of the shaft 83.

The weight of the counterweight 86 is designed to be approximately half of the maximum permissible load of the cage 80. That is, if the maximum permissible load of the cage 80 is 1,000 lbs, the weight of the counterweight 86 is 500 lbs. When passengers weighing half of the maximum permissible load board the cage 80, the cage 80 and the counterweight 86 are nearly balanced.

As shown in FIG. 3, the cage 80 is composed of a cab 106 and a cage frame around the cab 106. The cage frame is composed of a crosshead 104, a pair of uprights 105, a plank 109 is configured to be fitted between a pair of guide rails 103. The cab 106 has a car platform 111 and the car platform is secured to the plank 109 through anti-vibration materials (not shown) such as rubber. A support base 121 having a pair of axles 123 is attached to a lower side of the plank 109. The axles 123 are respectively arranged in parallel so as to be perpendicular to the cable 82 positioned between the car sheaves 81 and rotatably support the car sheaves 81. The cable 82 is driven by traction between the cable 82 and the traction sheave 85, and the cage 80 is moved up and down by the cable 82 along the guide rails 103.

However, in the above mentioned elevator, since the car sheaves 81 installed near the car platform 111 experience high speed rotation in contact with the cable 82, vibration and noise caused by the contact can be easily transferred to the cage 80.

Further, vibration caused by a change in tension of the cable 82 around a hoisting machine can be transferred to the cage 80 via the car sheaves 81. This tension change sometimes occurs at the time the torque of the motor of the hoisting machine 84 changes.

SUMMARY OF THE INVENTION

Accordingly, one object of the invention is to provide an elevator suspended by a cable through car sheaves, wherein vibration transferred from the cable can be attenuated to improve comfort of a ride in the cage.

This and other objects are achieved according to the present invention by providing a new and improved elevator including a cage for accommodating passengers configured to move up and down in a shaft along a guide rail, a support base attached to a lower portion of the cage, a plurality of car sheaves rotatably secured to the support base through respective axles, a cable placed around the car sheaves and configured to suspend the cage, and at least one damper coupled to the cage and configured to attenuate vibration transferred from the cable to the cage.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 4:
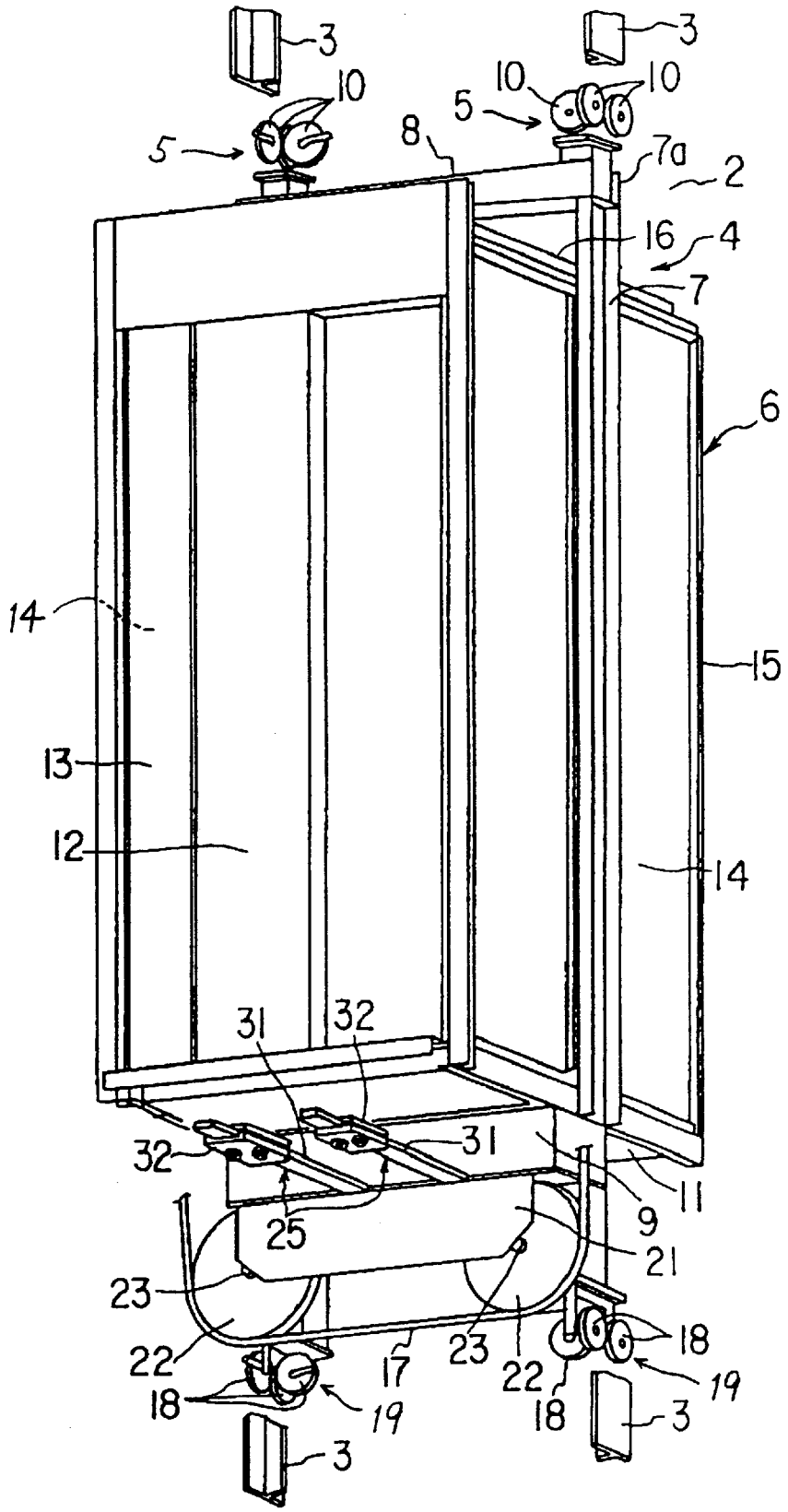
FIG. 4 is a perspective view of an elevator cage of a first embodiment of the present invention.
Figure 5:
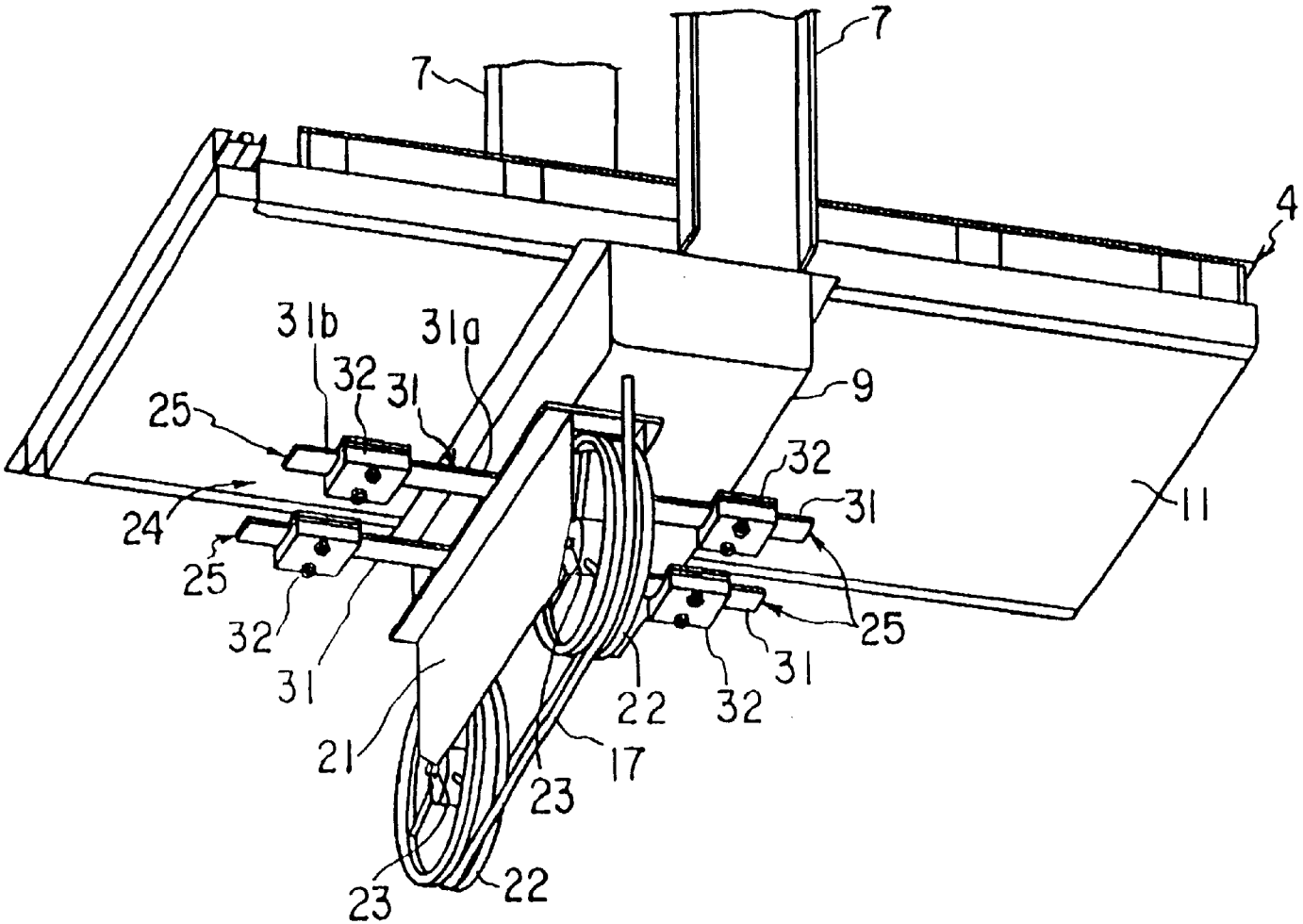
FIG. 5 is a partial perspective view of an elevator cage of a first embodiment of the present invention.
Figure 6:
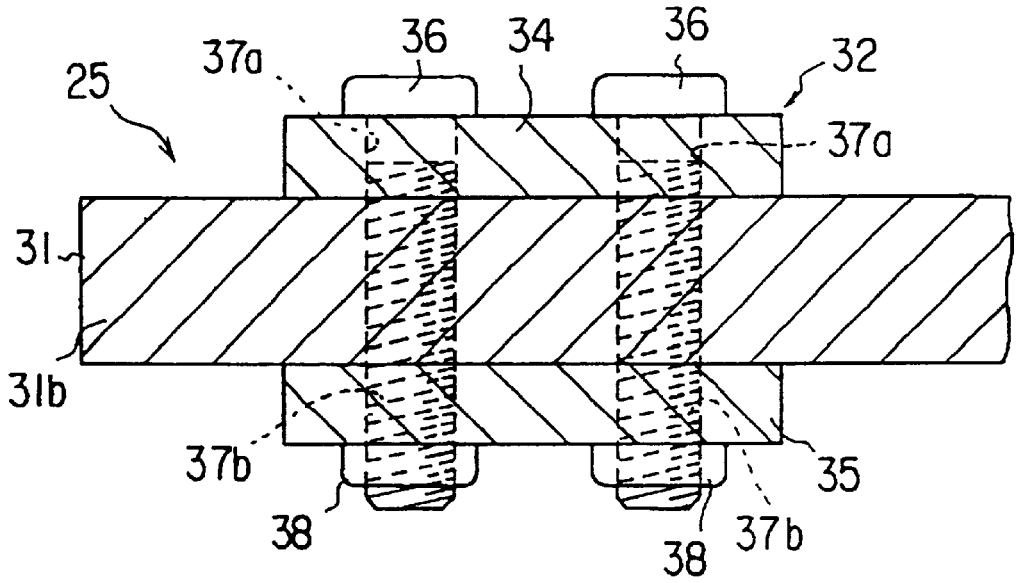
FIG. 6 is a sectional view of a plate bar of a first embodiment of the present invention.

Referring now to the drawings, wherein like reference numerals designate identical or corresponding parts throughout the several views and more particularly FIGS. 4–6 thereof, FIG. 4 shows an elevator cage of a first embodiment of the present invention.

Figure 1:
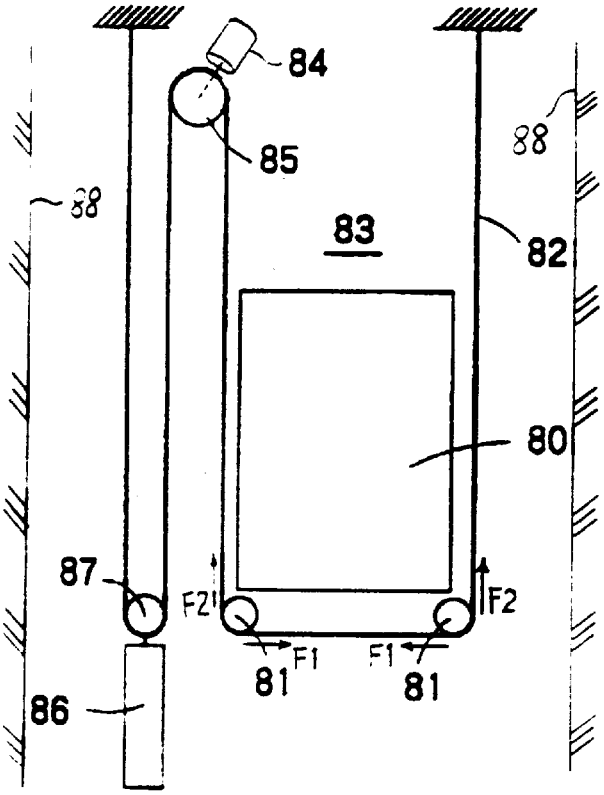
FIG. 1 (PRIOR ART)
FIG. 1 is a front view of one example of a traction type elevator.
Figure 2:
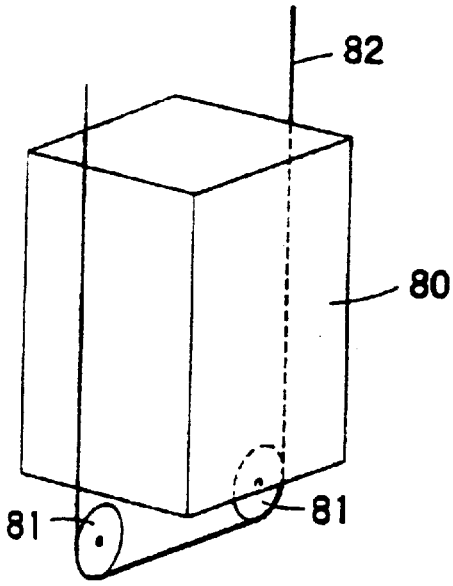
FIG. 2 (PRIOR ART)
FIG. 2 is a perspective view of an elevator cage shown in FIG. 1.
Figure 3:
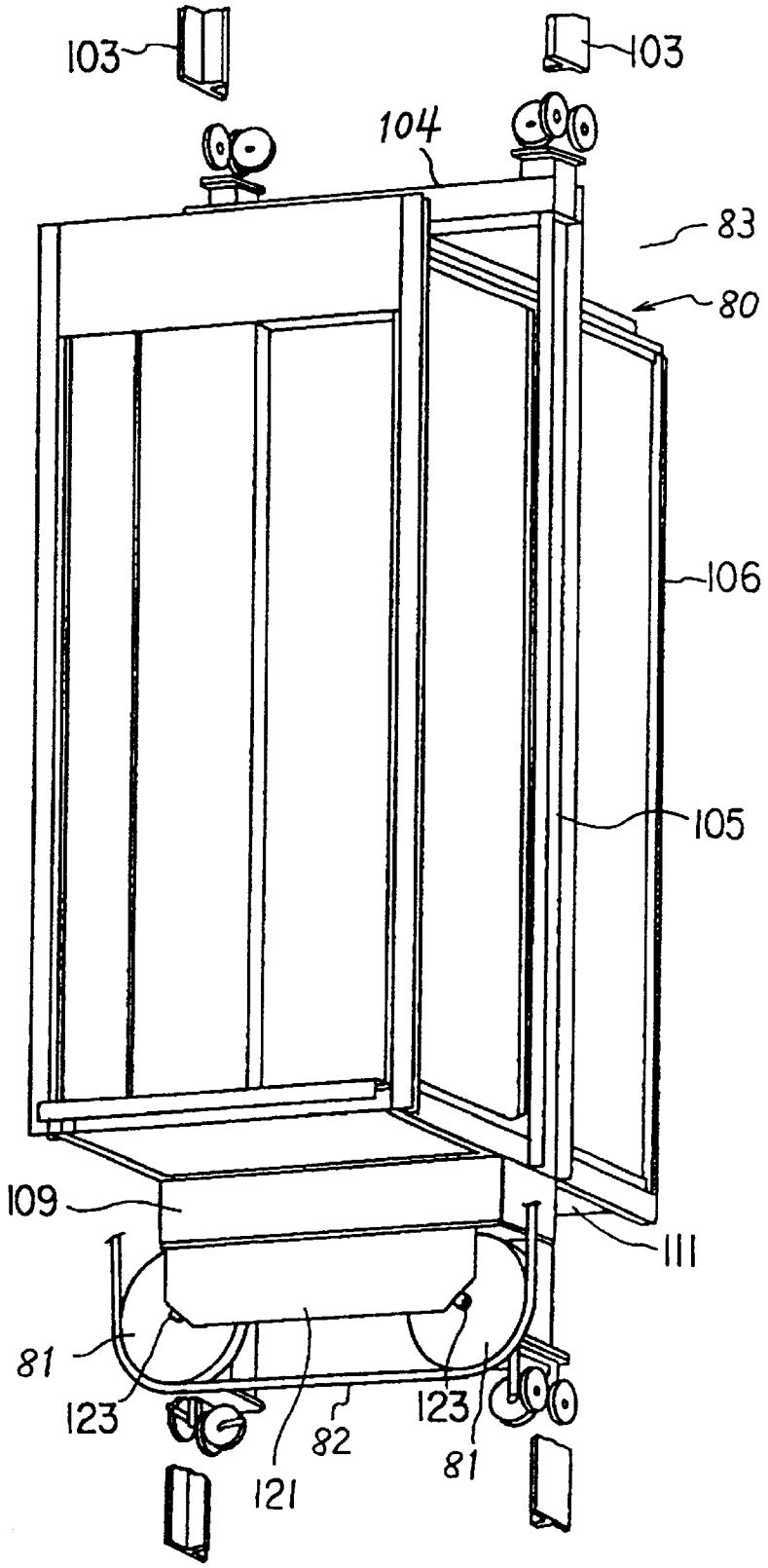
FIG. 3 (PRIOR ART)
FIG. 3 is a perspective view of an elevator cage shown in FIG. 1.

In the first embodiment, the structure for moving the elevator up and down is generally the same as that shown in FIG. 1. That is, opposite ends of a cable 17 are secured to the upper part of a shaft 2. The cable 17 is placed around a traction sheave 85 in FIG. 1 driven by a hoisting machine 84 having a motor (not shown). A cage 4 shown in FIG. 4 for accommodating passengers and a counterweight 86 shown in FIG. 1 for balancing the cage 4 are suspended by the cable 17 through a weight sheave 87 of the counterweight 86 and car sheaves 22 of the cage 4. Typically, plural cables 17, such as five or more, are actually used in practice in dependence on the rated load of the elevator. However, for the sake of simplicity, only a single cable 17 is shown in the drawings.

As shown in FIG. 4, a pair of guide rails 3 is arranged in parallel in the shaft 2. The cage 4 is composed of a cab 6 and a cage frame around the cab 6. The cage frame is composed of a cross head 8, a pair of uprights 7 and a plank 9, and formed to be fitted between the guide rails 3. A pair of upper guides 5 having rollers 10 is attached to the upper ends of the uprights 7, and the upper guides 5 guide the cage 4 along the guide rails 3.

The cab 6 has a car platform 11, a front panel 13 including a door 12, a pair of side panels 14 connected to both side of the front panel 13, a rear panel 15 and a ceiling panel 16 having lightings (not shown). The front panel 13, the side panels 14 and the rear panel 15 stand on the car platform 11, and the ceiling panel 16 is connected to the upper ends of the front panel 13, the side panels 14 and the rear panel 15. The car platform 11 is secured to the plank 9 through anti-vibration materials (not shown) such as rubber. A support base 21 having a pair of axles 23 is attached to a lower side of the plank 9. The axles 23 are respectively arranged in parallel so as to be perpendicular to the cable 17 positioned between the car sheaves 22 and rotatably support the car sheaves 22. The cable 17 is placed around the car sheaves 22 and driven by a traction between the cable 17 and the traction sheave 85, and the cage 4 is moved up and down by the cable 17 along the guide rails 3. A pair of lower guides 19 having rollers 18 are attached to opposite ends of the plank 9, and the lower guides 19 guide the cage 4 along the guide rails 3.

As shown in FIG. 5, four damper units 25 are attached to the support base 21. Each of the damper units 25 is composed of a plate bar 31 and a weight 32 attached on the plate bar 31. Each of the plate bars 31 extends in the depth direction of the cage 4, i.e. the direction is perpendicular to the cable 17 positioned between the car sheaves 22 That is, the plate bars 31 are arranged in parallel with the axles 23. The plate bars 31 each have one end secured to the support base 21 and an other end free to swing vertically. Each of the plate bars 31 is in effect a cantilever. Plate bars 31 on opposite sides of the support base 21 are integrally connected, with the center portion of the integrally connected bars 21 straddling and secured to the support base 21.

As shown in FIG. 6, each of the weights 32 is composed of a first weight 34 attached on the upper side of the plate bar 31 and a second weight 35 attached on the lower side of the plate bar 31. The first weight 34 has two holes 37*a* and the second weight 35 has two holes 37*b* to accommodate two bolts 36. The first weight 34 and the second weight 35 are secured on the plate bar 31 by the bolts 36 and nuts. The weights 32 are attached at respective desired position of the plate bars 3 in order to attenuate vibration from the car sheaves 22 effectively. Further, positions of the weights 32 on the plate bars 31 can be made adjustable along the plate bars 31 by providing plural holes spared along the plate bars 31. Alternatively the weights 32 can be adjustably clamped to the plate bars 31 at whichever position results in a desired characteristic vibration frequency for the resulting damper.

When vibration caused by a tension change of the cable 17 around the hoisting machine 84 is transferred to the cage 4 via the car sheaves 22, free ends 31*b* of the plate bars 31 swing vertically according to the vibration. As a result, the swing of the weights 32 functions to attenuate the vibration. The characteristic vibration of the damper unit 25 is changed by shifting a position of the weight 32 on the plate bar 31 or changing the weight of the weight 32. Accordingly, different vibration frequency bands can be attenuated by changing the characteristic vibration of the damper unit 25 as a function of the position and size (weight) of the weights 32.

In the first embodiment, since four damper units 25 are secured to the support base 21, four different frequency band of vibration can be attenuated by respectively setting four different characteristic vibrations of the four damper units 25. Even if the cage 4 has two different resonance frequencies, the damper units 25 can attenuate the vibration at the frequencies.

Figure 7:
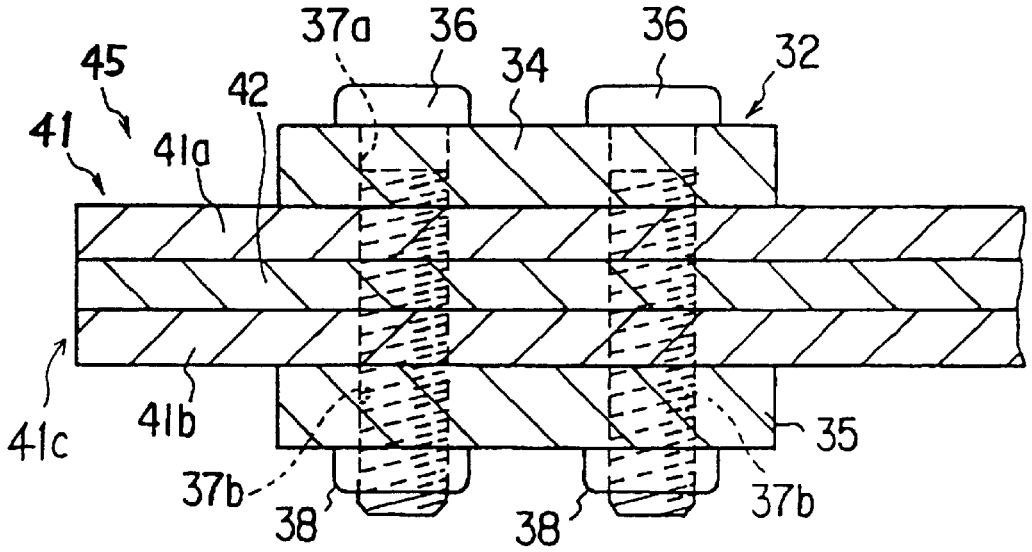
FIG. 7 is a sectional view of a plate bar of a second embodiment of the present invention.

FIG. 7 is a sectional view of a plate bar of a second embodiment of the present invention.

In the following description, only components different from the components explained in the first embodiment shown in FIGS. 4–6 are described.

In this embodiment, as shown in FIG. 7, damper units 45 (only one is shown) are substituted for the damper units 25 shown in FIG. 6. Each of the damper units 45 is composed of a plate bar 41 including two plates 41*a* and 41*b*, a damping element 42 such as a polymer resin or a damping rubber lain between the plates 41*a* and 41*b*, and weight 32.

According to the second embodiment, when vibration caused by a tension change of the cable 17 around the hoisting machine 84 is transferred to the cage 4 via the car sheaves 22, free ends 41*c* of the plate bars 41 swing vertically to attenuate the vibration. Further, since the damping element 42 absorbs a transferred vibration energy of the plate bars 41 from the car sheaves 22, vibration transferred to the cage 4 can be efficiently attenuated.

Furthermore, the plate bars 41 can be made of a highly damped steel element such as "VIBLESS" which is a brand name owned by NIPPON STEEL CORPORATION. In this case, the plate bars 41 attenuate the vibration from the car sheaves 22, and the transferred vibration energy of the plate bars 41 is self absorbed.

Moreover, the damper units 25 and 45 can be secured to the plank 9. In this case, vibration from the car sheaves 22 is attenuated in the same way.

Figure 8:
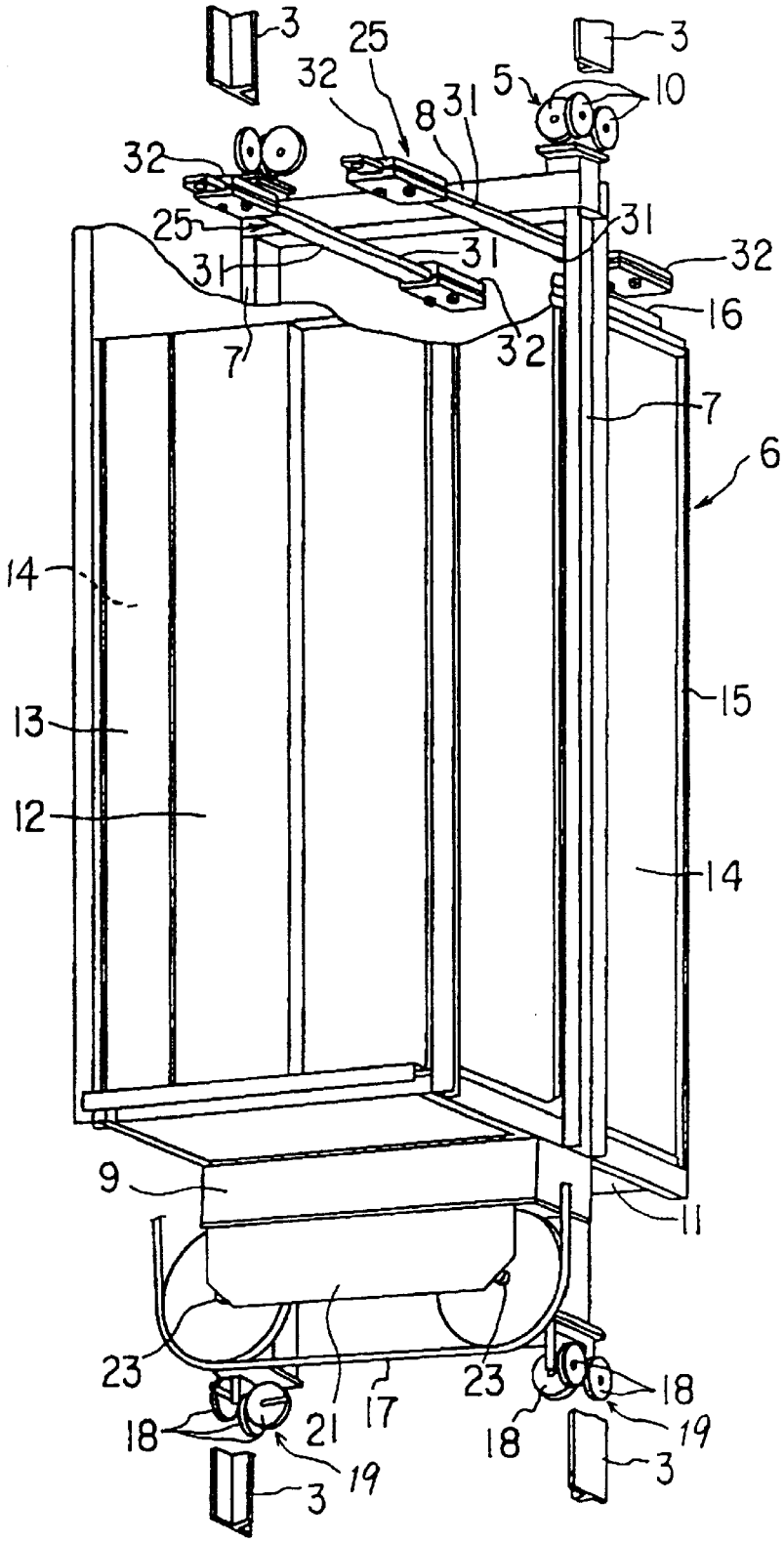
FIG. 8 is a perspective view of an elevator cage of a second embodiment of the present invention.

Further, as shown in FIG. 8, the damping units 25 and 45 can be secured to the lower side of the cross head 8. In this case, vibration from the car sheaves 22 is attenuated in the same way as in the first embodiment.

Figure 9:
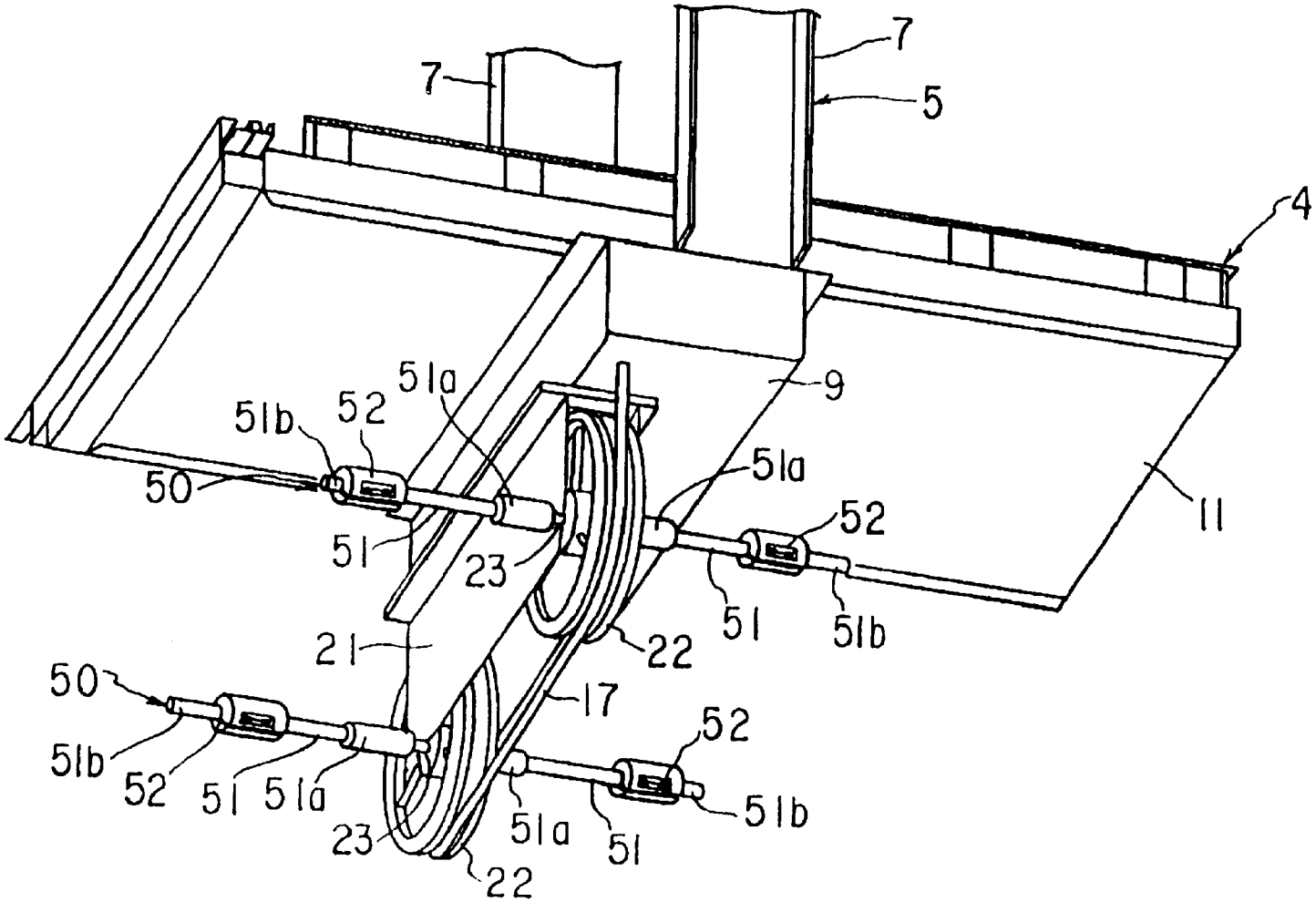
FIG. 9 is a perspective view of a lower portion of an elevator cage of a third embodiment of the present invention.

FIG. 9 is a perspective view of a lower portion of an elevator cage of a third embodiment of the present invention.

In the following description, only components different from the components explained in the first embodiment shown in FIGS. 4–6 are described.

In this embodiment, as shown in FIG. 9, four damper units 50 are attached to the support base 21. Each of the damper units 50 is composed of a bar 51 and a weight 52 attached on the bar 51. The bars 51 each have one end secured to a respective axle 23 and an other end free to swing vertically. Each of the bars 51 is in effect cantilever. Bars 51 on opposite sides of the support base 21 have the same structure. That is, the center of each bar 51 is secured to the axle 23 by means of a sleeve 51*a*.

Figure 10:
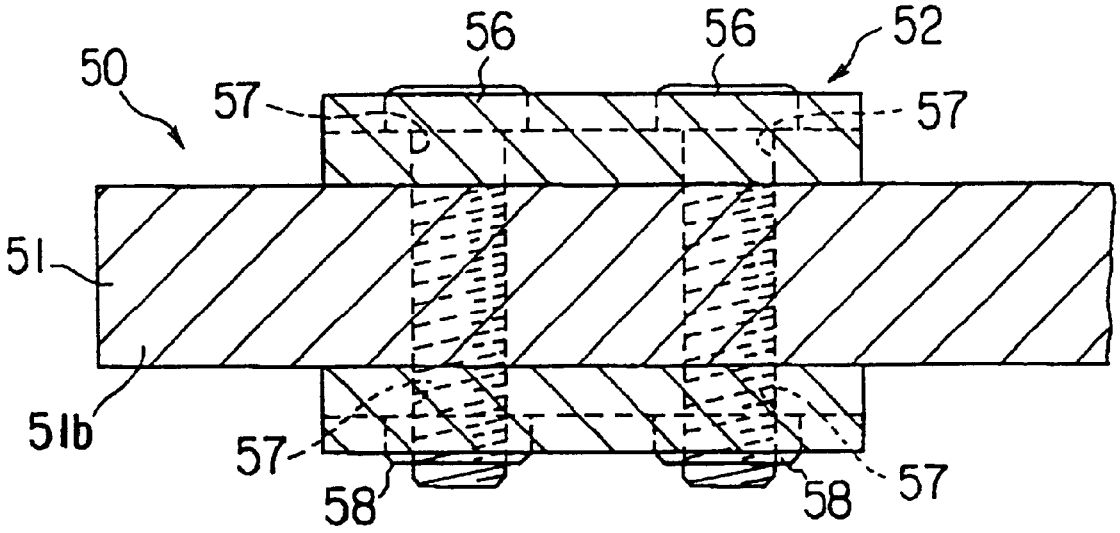
FIG. 10 is a sectional view of a damper unit of a third embodiment of the present invention.

As shown in FIG. 10, each of the weights 52 is formed cylindrically so as to insert the bars 51, and has a slit. Further, each of the weights 52 has four holes 57 for accommodating two bolts 56. Each of the weights 52 is secured on the bar 51 by the bolts 56 and nuts 58 as shown in FIG. 10. The weights 52 are attached on desired position of the bars 51 respectively in order to attenuate vibration from the car sheaves 22. Further, respective positions of the weights 52 on the bars 51 are adjustable along the bars 51 such as, for example, as above described with respect to FIG. 6.

When vibration caused by a tension change of the cable 17 around the hoisting machine 84 is transferred to the cage 4 via the car sheaves 22, free ends 51*b* of the bars 51 swing vertically according to the vibration. Accordingly, the swing of the weights 52 functions to attenuate vibration. The characteristic vibration of the damper unit 50 can be changed by shifting a position of the weight 52 on the bar 51 or changing the weight of the weight 52. Accordingly, different frequency bands of vibration can be attenuated by changing the characteristic vibrations of the damper units 50.

In the third embodiment, since four damper units 50 are secured to the support base 21, four different vibration frequency bands can be attenuated by respectively setting four different characteristic vibrations of the four damper units 50. Even if the cage 4 has two and more different resonance frequencies, the damper units 50 can attenuate up to four different frequency bands of vibration.

Figure 11:
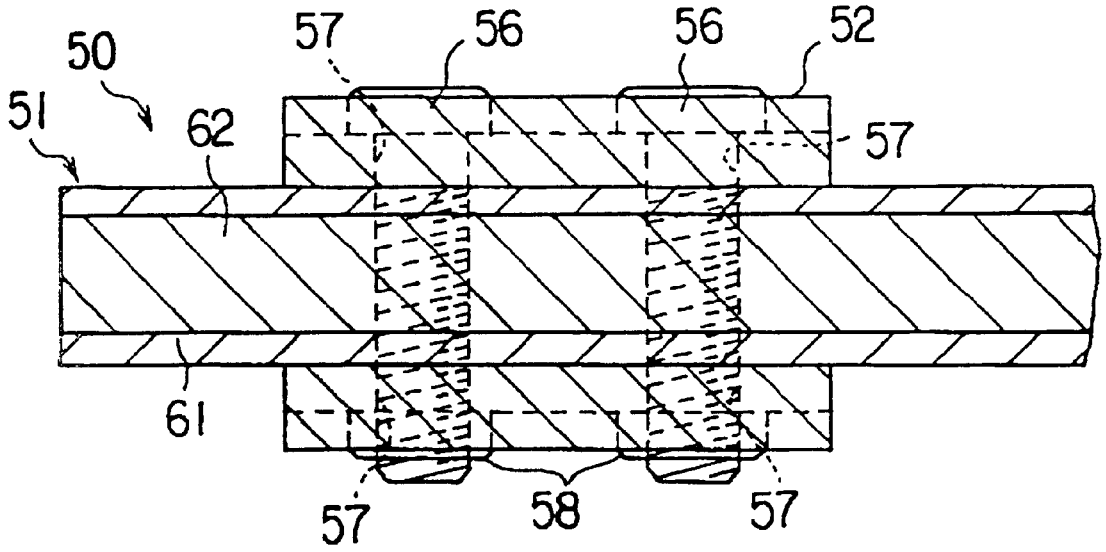
FIG. 11 is a sectional view of a damper unit of a third embodiment of the present invention.

Further, the bars 51 can be made of highly damped steel materials (e.g. "VIBLESS" which is a brand name owned by NIPPON STEEL CORPORATION), or can be composed of a cylindrical bar 61 and a damping rubber 62 filled in the cylindrical bar 61 as show in FIG. 11. A resin can be substituted for the damping rubber 62. In this case, the bars 51 attenuate the vibration from the car sheaves 22 in the same way as the first embodiment, in addition, the transferred vibration energy of the bars 31 is self absorbed.

Moreover, the damper units 50 can be secured to the plank 9 or the lower side of the cross head 8. In this case, vibration from the car sheaves 22 is attenuated as well.

Figure 12:
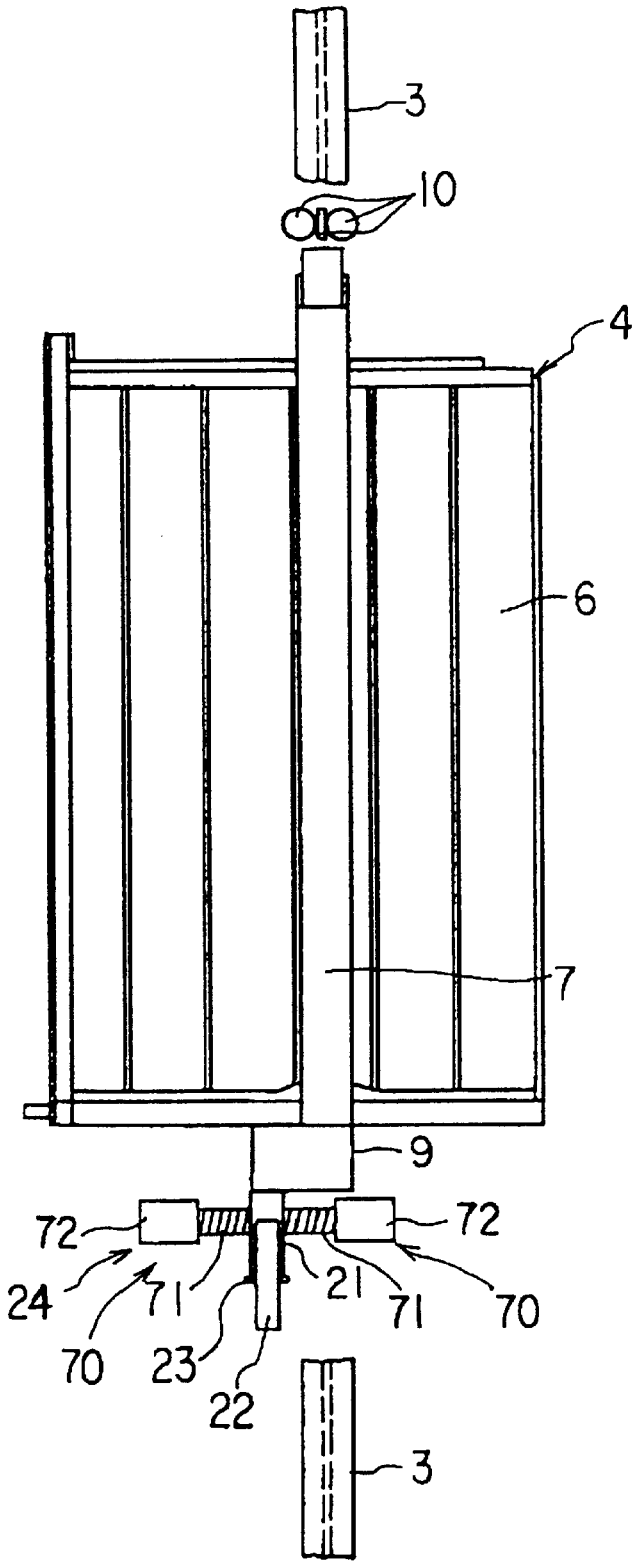
FIG. 12 is a side view of an elevator cage of a fourth embodiment of the present invention.

FIG. 12 is a side view of an elevator cage of a fourth embodiment of the present invention.

In the following description, only components different from the components explained in the first embodiment shown in FIGS. 4–6 are described.

In the embodiment of FIG. 12, spring units 70 are substituted for the damper units 25 shown in FIG. 5. Four spring units 70 (only two are shown) are attached to the support base 21. Each of the spring units 70 is composed of a coil spring 71 and a weight 72 attached to the coil spring 71. The coil springs 71 each have one end secured to the support base 21 and an other end free to swing vertically.

According to this embodiment, the spring units 70 attenuate the vibration from the car sheaves 22 in the same way as the first embodiment. In addition, since the coil springs 71 swing easier than the plate bars 31, the coil springs 71 can be designed shorter and smaller than the plate bars 31, and can save space to install the spring units 70.

Further, in the first, second and third embodiments, since respective of the plate bars 31, the bars 51 and the coil springs 71 are arranged in parallel with the axles 23, revolution vibration pivoting on the cable 17 and vertical vibration (i.e. vibration in the moving direction of the cage 4) are respectively attenuated effectively.

Figure 13:
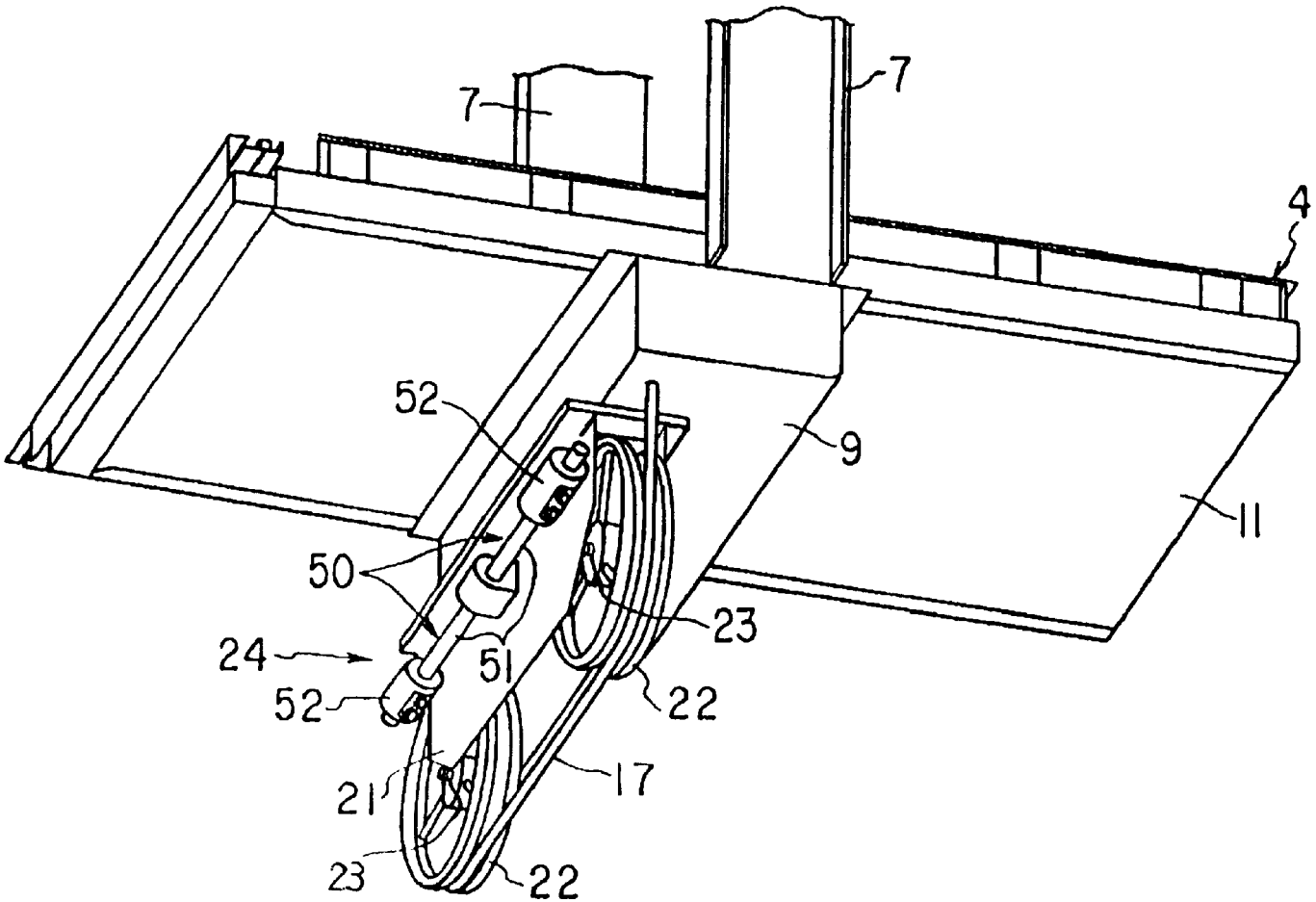
FIG. 13 is a perspective view of a lower portion of an elevator cage of a fifth embodiment of the present invention.

FIG. 13 is a partial perspective view of an elevator cage of a fifth embodiment of the present invention.

In the following description, only components different from the components explained in the third embodiment shown in FIG. 9 are described.

In FIG. 13, the damper units 50 are attached to the support base 21, but not coaxially with the axles 23. The center of the bar 51 is secured to the support base 21 and the weights 52 are attached to opposite ends of the bar 51, thereby to form integrally connected damper units 50. The bar 51 horizontally extends and intersects in the axis direction of the axles 23.

According to the fifth embodiment, the damper units 50 attenuate the vibration from the car sheaves 22 in the same way as the third embodiment, in addition, since the bar 51 extends horizontally and intersects in the axis direction of the axles 23, vertical vibration (i.e. vibration in the moving direction of the cage 4) is especially attenuated, and the installation of the damper unit 50 can be made compact.

Various modifications and variations are possible in light of the above teachings. For example, although in the embodiments shown in FIGS. 4–7 and 9–13, the damper units are shown attached to the support base 21, the same damper units can also be attached to the cage frame, such as the to the cross head 8 as shown in FIG. 8, in addition to, or in substitution for, the damper units shown in FIGS. 4–7 and 9–13 attached to the support base 21. Therefore, it is to be understood that within the scope of the appended claims, the present invention may be practiced otherwise than as specifically described herein.

What is claimed as new and desired to be secured by Letters Patent of the United States is:

1. An elevator, comprising:

a passenger cage configured to move up and down in a shaft along a guide rail;

a support base attached to a lower portion of said cage;

a plurality of car sheaves rotatably secured to said support base through respective axles;

a cable placed around said car sheaves and configured to suspend said cage; and at least one damper coupled to said support base and configured to attenuate vibration transferred from said cable to said cage;

wherein said at least one damper comprises:

a horizontally extending member including a vibration attenuating element, having a secured end coupled to said support base and a free end free to swing vertically;

a weight attached to said horizontally extending member so as to attenuate vibration transferred from said cable to said cage, and a position of said weight on said horizontally extending member is adjustable and the weight is positioned to attenuate a particular frequency band of vibration.

2. The elevator as recited in claim 1, wherein:

said horizontally extending member is composed of a damped steel.

3. The elevator as recited in claim 2, wherein said at least one damper comprises:

a plurality of dampers having different characteristic vibration frequencies.

4. The elevator as recited in claim 1, wherein said cage comprises a cab arranged in a cage frame, further comprising:

a further damper secured to said cage frame.

5. The elevator as recited in claim 4, wherein said at least one damper comprises:

a plurality of dampers having different characteristic vibration frequencies.

6. The elevator as recited in claim 4, wherein said horizontally extending member comprises a damped steel.

7. The elevator as recited in claim 1, wherein said at least one damper comprises:

a plurality of dampers having different characteristic vibration frequencies.

8. The elevator as recited in claim 1, further comprising:

a vibration damping element disposed between and weight and said horizontally extending member;

wherein said horizontally extending member comprises a plurality of plates and said vibration damping element is disposed between said plates.

9. The elevator recited in claim 8, wherein said vibration damping element comprises a polymer resin material or a rubber material.

10. The elevator as recited in claim 9, wherein said at least one damper comprises:

a plurality of dampers having different characteristic vibration frequencies.

11. The elevator as recited in claim 8, wherein said at least one damper comprises:

a plurality of dampers having different characteristic vibration frequencies.

12. The elevator as recited in claim 1, wherein said horizontally extending member comprises:

a plurality of plates; and a vibration damping element disposed between said plates.

13. The elevator as recited in claim 12, wherein said plates comprise damped steel.

14. An elevator comprising:

a passenger cage configured to move up and down in a shaft along a guide rail;

wherein said cage comprises a cab arranged in a cage frame;

a support base attached to a lower portion of said cage;

a plurality of car sheaves rotatably secured to said support base through respective axles;

a cable placed around said car sheaves and configured to suspend said cage; and at least one damper coupled to said support base and configured to attenuate vibration transferred from said cable to said cage;

wherein said at least one damper comprises:

a horizontally extending member including a vibration attenuating element, having a secured end coupled to said support base and a free end free to swing vertically;

a weight attached to said horizontally extending member so as to attenuate vibration transferred from said cable to said cage, and a position of said weight on said horizontally extending member is adjustable and the weight is positioned to attenuate a particular frequency band of vibration.

15. The elevator as recited in claim 14, wherein said at least one damper comprises:

a plurality of dampers having different characteristic vibration frequencies.

16. The elevator as recited in claim 14, wherein said horizontally extending member comprises a damped steel.

* * * * *